US010385598B2

(12) United States Patent
Shah et al.

(10) Patent No.: US 10,385,598 B2
(45) Date of Patent: Aug. 20, 2019

(54) TIP FOR GEARED HINGE

(71) Applicant: ARCHITECTURAL BUILDERS HARDWARE MFG., INC., Itasca, IL (US)

(72) Inventors: Ankit Shah, South Barrington, IL (US); Rafael Prieto Velasco, Chicago, IL (US)

(73) Assignee: ARCHITECTURAL BUILDERS HARDWARE MFG., INC., Itasca, IL (US)

( * ) Notice: Subject to any disclaimer, the term of this patent is extended or adjusted under 35 U.S.C. 154(b) by 10 days.

(21) Appl. No.: 15/864,677

(22) Filed: Jan. 8, 2018

(65) Prior Publication Data

US 2019/0211595 A1 Jul. 11, 2019

(51) Int. Cl.
*E05D 3/12* (2006.01)
*E05D 11/00* (2006.01)

(52) U.S. Cl.
CPC ..... *E05D 11/0054* (2013.01); *E05D 3/122* (2013.01); *E05Y 2201/11* (2013.01); *E05Y 2201/71* (2013.01); *E05Y 2900/132* (2013.01); *Y10T 16/533* (2015.01)

(58) Field of Classification Search
CPC ... E05D 3/122; E05D 11/0054; Y10T 16/533; E04D 3/366; E04F 19/062; E05Y 2201/11
USPC ..... 52/459, 465
See application file for complete search history.

(56) References Cited

U.S. PATENT DOCUMENTS 1,341,063 A * 5/1920 McQueen ..... E05D 3/02 16/262
1,865,674 A * 7/1932 Carter ..... E04D 3/366 52/459
1,925,769 A * 9/1933 McAvoy ..... E04B 1/14 52/459
2,047,909 A * 7/1936 North ..... E05D 3/02 16/250
2,969,589 A * 1/1961 Fromson ..... B21D 39/03 160/40
3,431,590 A * 3/1969 Anderson ..... E05D 11/00 16/223

(Continued)

FOREIGN PATENT DOCUMENTS

DE 20017814 U1 3/2001
EP 3011880 A1 4/2016
GB 2528545 A 1/2016

OTHER PUBLICATIONS

United Kingdom Search Report from corresponding United Kingdom Patent Application No. GB1818009.1, dated May 2019.

*Primary Examiner* — Jeffrey O'Brien

(74) *Attorney, Agent, or Firm* — Greer, Burns & Crain, Ltd.

(57) ABSTRACT

A tip is provided for a geared hinge including a first leaf, a second leaf and a cap enclosing complementary meshed edges of the first and the second leaves, at least one of the first leaf, the second leaf and the cap defining a channel. The tip includes a body with a depending tongue constructed and arranged for complementary engagement in the channel, an angled upper end projecting vertically from the tongue, the upper end including an inclined surface extending from a top portion to the tongue, the inclined surface defining an overhang extending on at least one side of the tongue for covering the channel.

17 Claims, 7 Drawing Sheets

(56) References Cited

U.S. PATENT DOCUMENTS 3,475,784 A * 11/1969 Foltz ..... E05D 5/128 16/380
3,977,043 A * 8/1976 Zernig ..... E05D 3/04 16/270
4,570,291 A * 2/1986 Smith ..... E05D 11/0054 16/250
4,864,688 A * 9/1989 Gerber ..... E05D 3/02 16/261
5,782,282 A * 7/1998 Chen ..... E05D 3/12 16/250
7,341,242 B2 * 3/2008 Bertato ..... E04H 17/1439 256/65.11
7,698,783 B2 * 4/2010 Heid ..... E05D 7/0027 16/242
7,739,840 B1 * 6/2010 Castellanos ..... E04D 12/008 52/198
7,797,899 B2 * 9/2010 Linn ..... E04B 1/6804 52/273
8,286,403 B2 * 10/2012 Schacht ..... E04F 15/02005 52/211
8,312,596 B2 * 11/2012 Self ..... A47K 3/36 16/250
8,505,880 B2 * 8/2013 Langenwalter ..... E04H 17/1443 256/65.08
8,870,309 B2 * 10/2014 Chen ..... E06B 3/482 160/206
8,898,861 B2 * 12/2014 Schau ..... E05D 11/0054 16/250
9,290,974 B2 * 3/2016 Alexander ..... E05D 3/122
9,297,190 B2 * 3/2016 Lee ..... E05D 3/122
RE46,240 E * 12/2016 Schau ..... E05D 11/0054
9,848,502 B1 12/2017 Chu et al.
10,190,329 B2 * 1/2019 Kobelt ..... E04H 12/04
2002/0000072 A1 * 1/2002 McGrath ..... E04F 13/0812 52/466
2002/0178666 A1 * 12/2002 Jurvis ..... E04F 19/02 52/233
2005/0076594 A1 * 4/2005 Warner ..... B60R 13/02 52/459
2006/0059662 A1 * 3/2006 Roeper ..... E05D 5/06 16/382
2006/0101760 A1 * 5/2006 Cahoon ..... E06B 1/003 52/459
2007/0245662 A1 * 10/2007 Stanchfield ..... E04D 1/365 52/459
2007/0283654 A1 * 12/2007 Stanchfield ..... B23D 45/003 52/465
2008/0053004 A1 * 3/2008 Oberoi ..... E04D 1/30 52/43
2008/0053026 A1 * 3/2008 Voegele, Jr. ..... E04D 3/361 52/582.1
2009/0019804 A1 * 1/2009 Spielman ..... E04C 3/07 52/466
2011/0036039 A1 * 2/2011 Wang ..... E04D 3/30 52/582.2
2012/0096677 A1 * 4/2012 Ho ..... E05D 7/105 16/250
2016/0146529 A1 * 5/2016 Choi ..... F25D 23/062 312/404

* cited by examiner

TIP FOR GEARED HINGE

BACKGROUND

The present invention relates generally to door hinges, and more specifically to such hinges used for doors in commercial or institutional applications, which are generally referred to as geared hinges or continuous geared hinges.

Continuous gear hinges tolerate considerably more abuse than more traditional knuckle hinges, and for that reason are found on doors which see substantial use, such as those at the main entrances to schools and public buildings, often as replacements for knuckle hinges. Continuous gear hinges are also employed in doorways of medical care facilities, including hospitals, clinics, rehabilitation centers, nursing homes and the like. The typical gear hinge has two leaves, each provided with a gear segment. Gear segments of each leaf mesh together and allow relative rotation that accommodates opening and closing of the door, while being held together with a cap that extends over and behind them. One of the hinge leaves is attached to the door that the hinge supports, while the other is secured to the hinge jamb of the door frame out of which the door opens. Both leaves, and the cap extend the full length of the door, thus providing multiple locations at which to attach the hinge to the door and hinge jamb.

On the contrary, more traditional knuckle-type hinges secure the door to the hinge jamb at small isolated areas, and may pull away from one or the other or both, particularly when used on doors that see heavy or abusive use. Also, knuckle-type hinges, as well as some types of continuous geared hinges, have been found to create a point of support for cords or pieces of clothing used by medical patients to injure themselves.

Thus, there is a need for an improved continuous geared hinge that prevents the functioning of the hinge as a holding or retention point for a cord, rope or other ligature.

SUMMARY

The above-listed need is met or exceeded by the present geared hinge, which features an at least one part, and in some cases a three-part tip insert that covers upper portions of the hinge and prevents objects such as rope, cords, belts, etc., collectively referred to as ligatures, from being hung or supported on the hinge. It is contemplated that the present hinge tip is installable on new hinges, as well as being retrofit upon existing hinge installations. A feature of the present hinge tip is that it provides inserts for at least one and preferably each of three hinge portions, a first leaf, a second leaf and a cap, where each insert includes a tongue for complementary insertion into a channel in the hinge, and an angled top surface that covers upper ends of the hinge portions and prevents attachment of an unwanted ligature, such as a cord, rope, belt or the like. Further, when such inserts are provided to both leaves and the cap of the hinge, the leaf inserts include overhang portions that overlap the angled top surface of the cap insert during the movement of the door from a closed position to an open position.

More specifically, a tip is provided for a geared hinge including a first leaf, a second leaf and a cap enclosing complementary meshed edges of the first and the second leaves, at least one of the first leaf, the second leaf and the cap defining a channel. The tip includes a body with a depending tongue constructed and arranged for complementary engagement in the channel, an angled upper end projecting vertically from the tongue, the upper end including an inclined surface extending from a top portion to the tongue, the inclined surface defining an overhang extending on at least one side of the tongue for covering the channel.

In another embodiment, a set of tips is provided for use with a geared hinge including a first leaf, a second leaf and a cap enclosing complementary meshed edges of the first and the second leaves, at least one of the first leaf, the second leaf and the cap defining a channel. The tips include a first tip with a first body having a depending tongue constructed and arranged for complementary engagement in the channel, a first angled upper end projecting vertically from the tongue, the upper end including an inclined surface extending from a top portion to the tongue, the inclined surface defining an overhang extending on at least one side of the tongue for covering the channel. Also included is a pair of supplemental tips, each having a supplemental body with a depending tongue for engagement in a respective channel in one of the first and second leaves, and a supplemental angled upper end with a supplemental inclined surface defining an overhang covering the respective channel.

In still another embodiment, a continuous gear hinge is provided, including a first leaf having a free end and a geared end, a second leaf having a free end and a geared end, a cap defining a channel dimensioned for enclosing the geared ends, and having an elongate rib defining a pivot point for each of the first and second leaves. At least one tip has a body with a depending tongue constructed and arranged for complementary engagement in the channel, and an angled upper end projecting vertically from the tongue, the upper end including an inclined surface extending from a top portion to the tongue, the inclined surface defining an overhang extending on at least one side of the tongue for covering the channel.

In one embodiment, the tip has a rear wall that is constructed and arranged for covering an opening or gap in the channel. Also, in one embodiment, the tip has a pair of cylindrical grooves for slidingly engaging ribs on the cap forming pivot points of the first and second leaves. In the preferred embodiment, the angled upper end of the tip includes the inclined surface which is located between a pair of side surfaces, each having an inclined portion. It is contemplated that the inclined surface has an area greater than either of the side surfaces.

In another embodiment, the top portion of the angled upper end has a planar portion. In an alternate embodiment, the angled upper end defines a sharp upper edge. In other embodiments, the tongue is generally "T"-shaped when viewed in horizontal cross-section, depending on the shape of the respective channel. Where the supplemental tips are provided, in one embodiment each of the supplemental tips includes an overlapping portion of the supplemental angled upper end that overhangs a portion of the first tip for accommodating pivoting movement of a door relative to a door frame.

DETAILED DESCRIPTION

Figure 1:
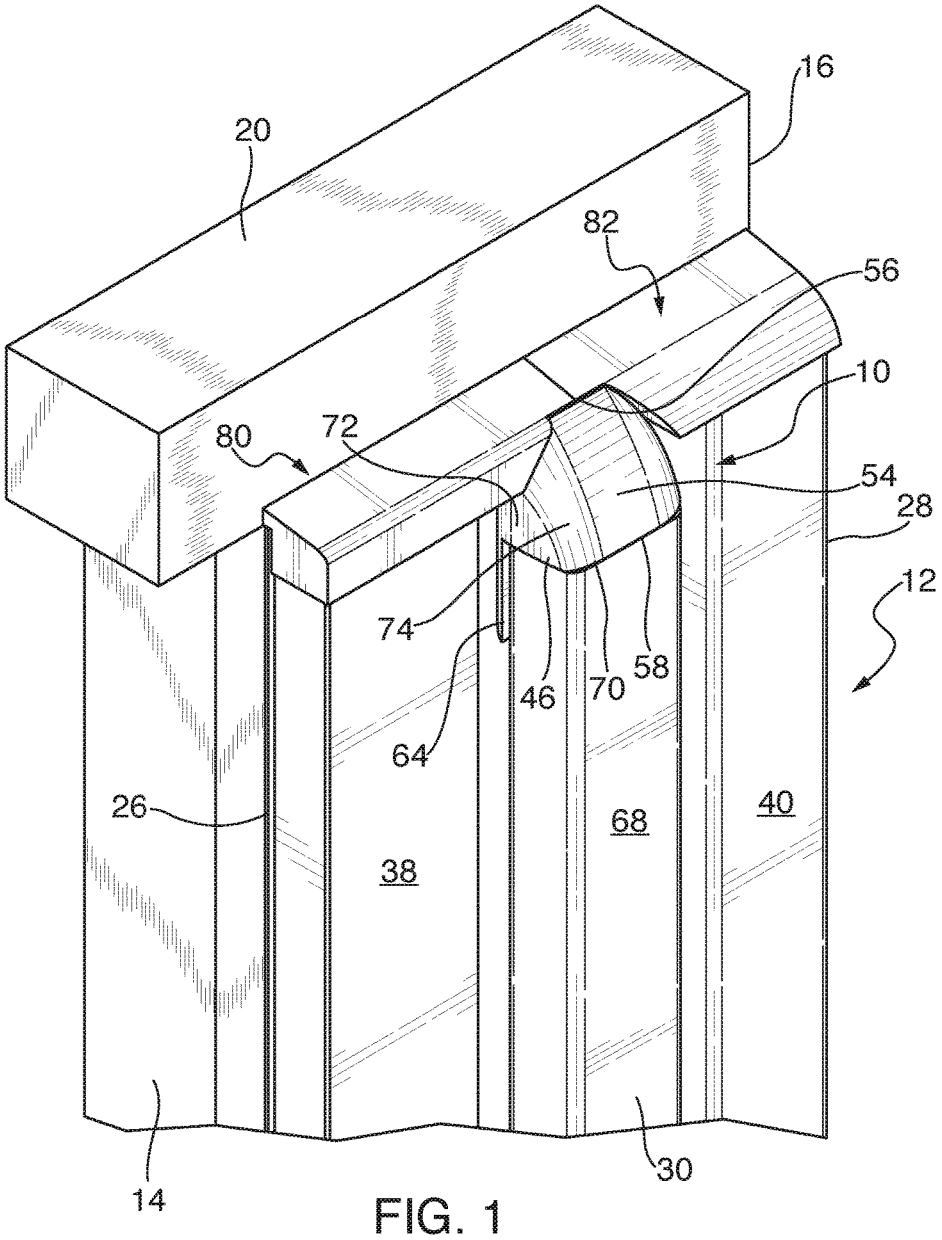
FIG. 1 is a fragmentary top perspective view of the present hinge and tip mounted on a door, shown in the closed position.
Figure 2:
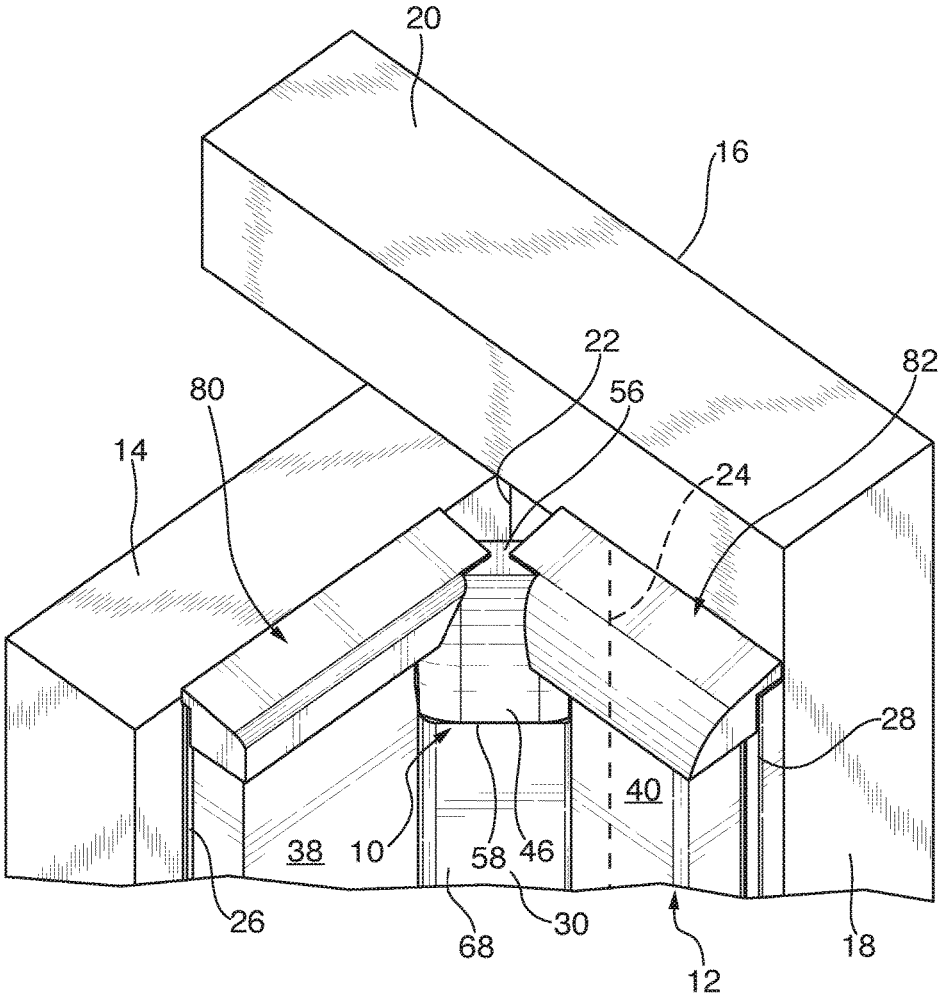
FIG. 2 is a fragmentary top perspective view of the present hinge and tip mounted to a door, shown in the open position.

Referring now to FIGS. 1 and 2, the present hinge tip is generally designated 10, and is shown mounted to a hinge, generally designated 12 used to secure a door 14 to a surrounding door frame 16. As is well known in the art, the door frame 16 includes a pair of spaced vertical members or jambs 18, joined together by an upper horizontal member or lintel 20. According to conventional practice, the hinge 12 is mounted between a complementary edge 22 of the door 14 and an edge 24 (shown hidden) of one of the jambs 18 of the door frame 16.

Figure 3:
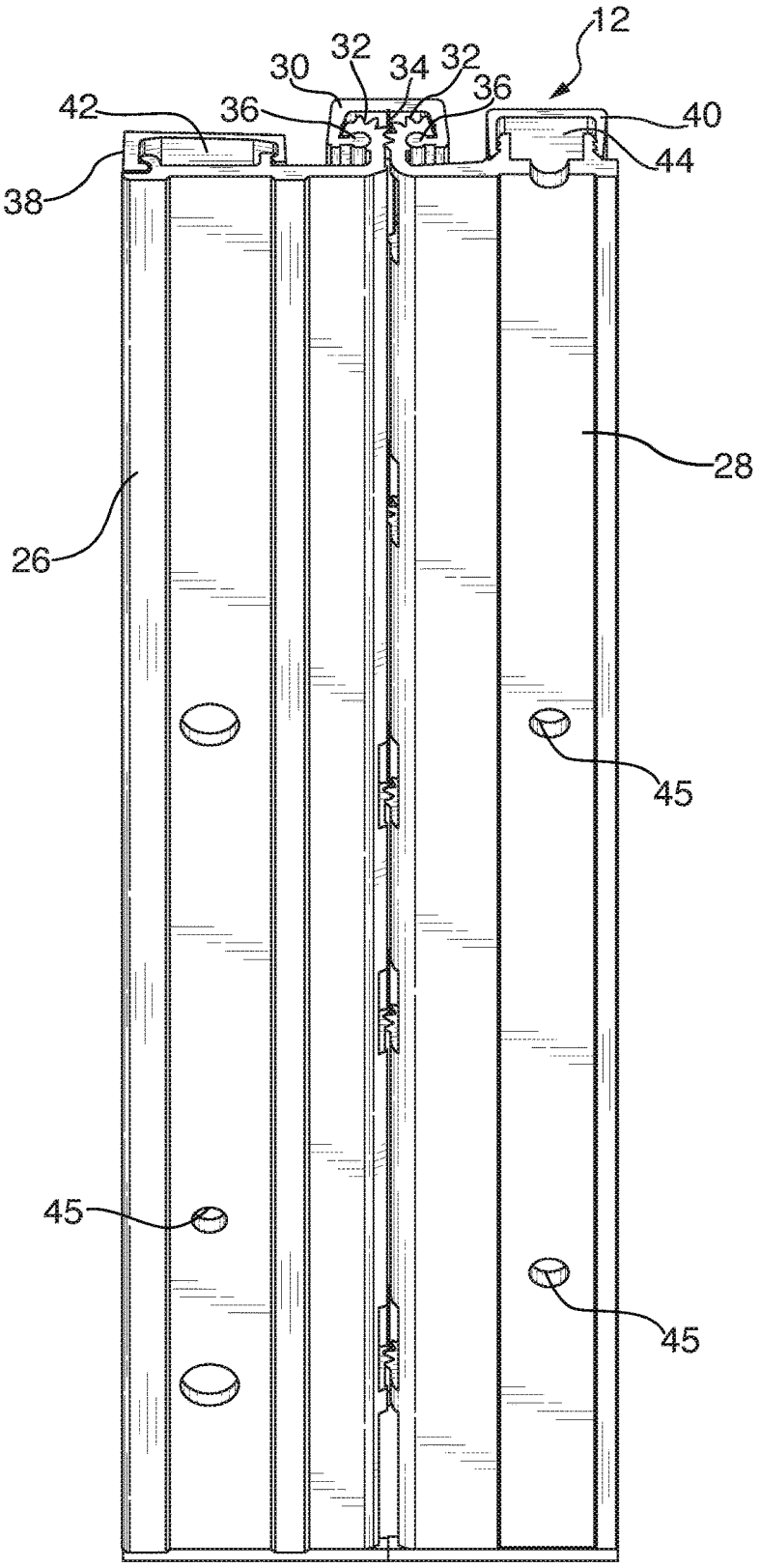
FIG. 3 is a fragmentary top perspective view of the present geared hinge without the present tips.
Figure 4:
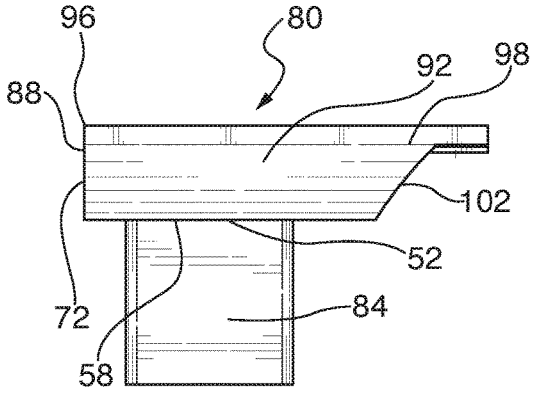
FIG. 4 is a front elevation view of the present left insert of the present tip.
Figure 6:
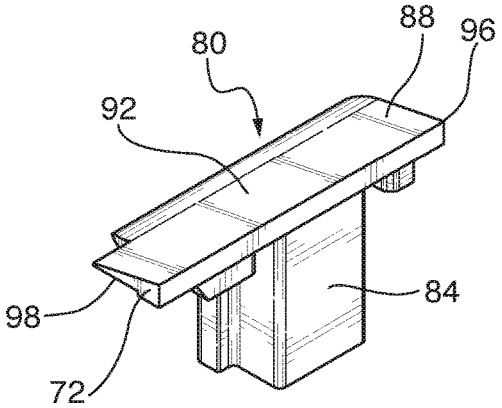
FIG. 6 is a top perspective view of the insert of FIG. 4.

Referring now to FIGS. 1-3, in the present application, the hinge 12 is shown as a continuous geared hinge, which as is well known in the art are provided in a variety of formats. In general, geared hinges like the hinge 12 include a first leaf 26 shown mounted to the door 14, a second leaf 28 shown mounted to the frame 16, and a cap 30 enclosing complementary meshed geared ends 32 (FIG. 3). In the preferred embodiment, the cap 30 is generally "U"-shaped when viewed from above, and defines a longitudinally extending channel 34. In addition, as is known in the art, the cap 30 includes a pair of axially or longitudinally extending cylindrical ribs 36 which are each pivotally engaged by a corresponding one of the geared ends 32 of each of the leaves 26, 28. As is known in the art, the cap 30 and the geared ends 32 preferably extend the full length of the hinge 12, and the door 14, however other lengths for these components are contemplated depending on the application. Also, it is common to include axially-spaced polymeric support bearings along the geared ends 32 (not shown).

Also, referring to the first and second leaves 26, 28, while each of the leaves is shown having a respective first and second cap 38, 40 defining corresponding first and second channels 42, 44, the present tip 10 is contemplated for use with other such hinges, including but not limited to geared hinges having planar leaves lacking such channels. Instead, the leaves 26, 28 are provided with mounting holes 45 for direct mounting to the door 14 and the door frame 16 which are plainly visible and not covered by caps. As shown, the first leaf 26 is wider than the second leaf 28, for applications when the door frame 16, specifically, the jambs 18 are relatively thin. It is to be understood that the sizes and shapes of the respective leaves 26, 28 may vary to suit the situation as is well known in the commercial hinge art.

Figure 16:
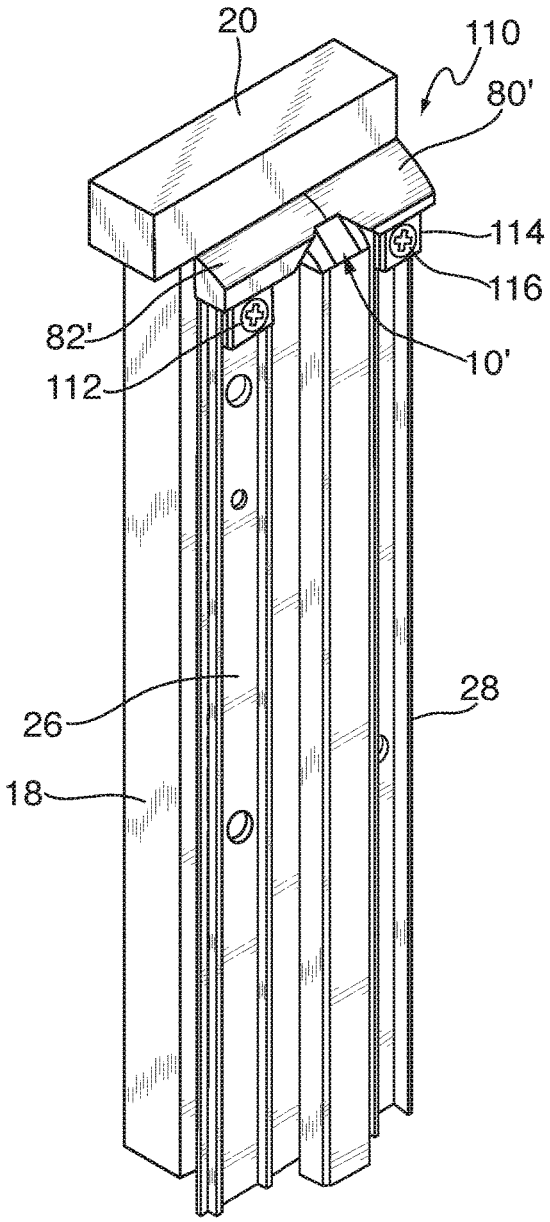
FIG. 16 is a fragmentary top perspective view of an alternate embodiment of the present tip.

An objective of the present tip 10 is to prevent the unwanted anchoring or supporting of a ligature by a resident, patient or other inhabitant of a room equipped with the present hinge 12. To this end, the present tip 10 is readily slidably mounted in the channel 34 (as well as channels 42, 44 when present) and secured in place by chemical adhesive such as epoxy or the like, or suitable fasteners securing the tip to the hinge 12 (FIG. 16). An angled or inclined surface on the tip 10 creates a condition where an attempt to secure a ligature will result in the ligature sliding off of the tip and away from the hinge.

Figure 14:
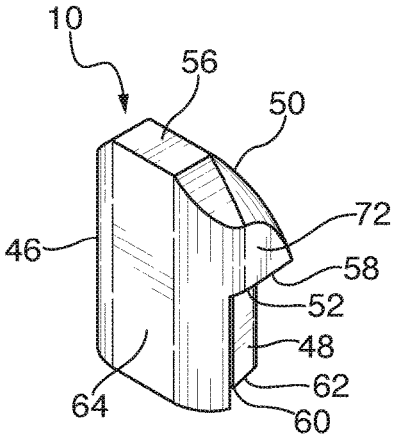
FIG. 14 is a top perspective view of the insert of FIG. 12.
Figure 15:
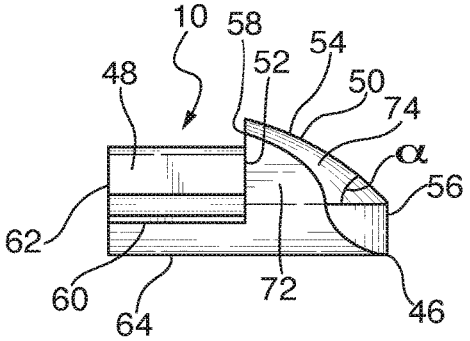
FIG. 15 is a right side view of the insert of FIG. 12.

Referring to FIGS. 1, 2 and 12-15, more specifically, the present tip 10 includes a body 46 with a depending tongue 48 constructed and arranged for complementary engagement in the channel 34, 42, or 44. An angled upper end 50 projects vertically from a top 52 of the tongue 48. Included on the angled upper end 50 is an inclined surface 54 extending from a top portion 56 to the tongue 48, preferably to a point even with the top 52 of the tongue. The inclined surface 54 is dimensioned to define an overhang 58 extending on at least one side of the tongue 48 for covering the channel 34, 42, 44. While other degrees of inclination are contemplated, depending on the application, in the preferred embodiment, the inclined surface 54 defines an angle $\alpha$ of approximately 45° relative to a longitudinal axis of the tip 10 (FIG. 15).

Figure 13:
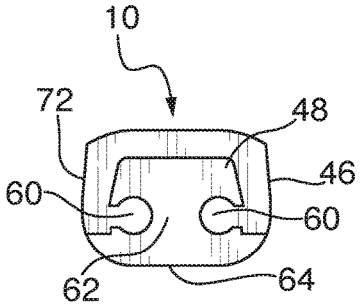
FIG. 13 is a bottom plan view of the insert of FIG. 12.

Due to the preferred engagement in the channel 34 in the cap 30, the tip 10 includes a pair of spaced, generally parallel, generally cylindrical grooves 60 in the tongue 48 that are open at a bottom end 62 for facilitating sliding engagement with the ribs 36. In addition, the tip 10 is preferably provided with a rear wall 64 dimensioned to cover an opening (not shown) in the channel 34 not covered by portions of the leaves 26, 28. As seen in FIG. 13, ends of the rear wall 64 extend laterally past the grooves 60. Also, as seen in FIGS. 1 and 15, the overhang 58 is dimensioned to extend past the tongue 48 a sufficient distance to create a smooth contour between the inclined surface 54 and an outer surface 68 of the cap 30. In this manner, the objective of preventing any support of ligatures is achieved.

As seen in FIG. 1, in one embodiment, upon assembly, the overhang 58 of the inclined surface 54 is dimensioned so that a thin edge 70 of the cap 30 is exposed, however this edge is insufficient for supporting ligatures. Further, the dimensions of the upper angled end 50 are contemplated as varying to suit the application, so that in some embodiments, the thin edge 70 is covered.

Referring again to FIGS. 1 and 12-15, the angled upper end 50 includes the inclined surface 54 sandwiched between two side surfaces 72 which are contoured with inclined portions 74 to present an overall angled end to the hinge 12 that will prevent the securing of a ligature. The side surfaces 72 terminate at the overhang 58. Also, it will be seen that the inclined surface 54 has an area that is greater than either of the side surfaces 72. Also, as seen in FIGS. 14 and 15, the top portion 56 of the angled upper end 50 is preferably planar, the size of which may vary to suit the application.

Referring now to FIGS. 1-11, in applications where at least one and preferably both of the first and second leaves 26, 28 have their own channels 42, 44 (FIG. 3), the present tip 10 is supplemented by pair of supplemental tips 80 82, each designated for orientation on one of the left (door) and right (frame) sides of the cap 30 as seen from the orientation of FIG. 1. Each of the supplemental tips 80, 82 is constructed and arranged for insertion in each of the channels 42, 44 of the first and second leaves 26, 28, each tip 80, 82 having a tongue 84, 86 and an angled upper end 88, 90 with an inclined surface 92, 94.

Figure 5:
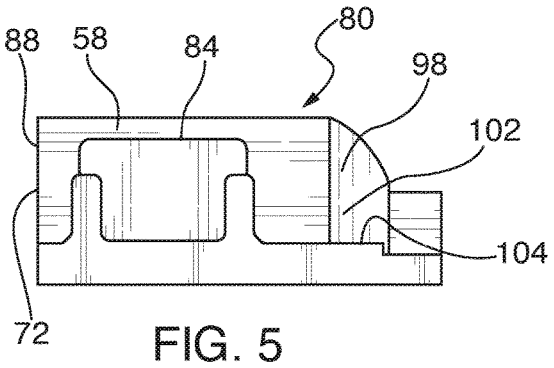
FIG. 5 is a bottom plan view of the insert of FIG. 4.
Figure 7:
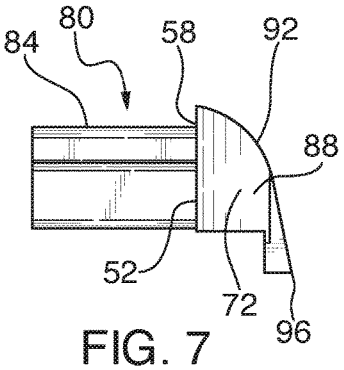
FIG. 7 is a right side view of the insert of FIG. 4.
Figure 8:
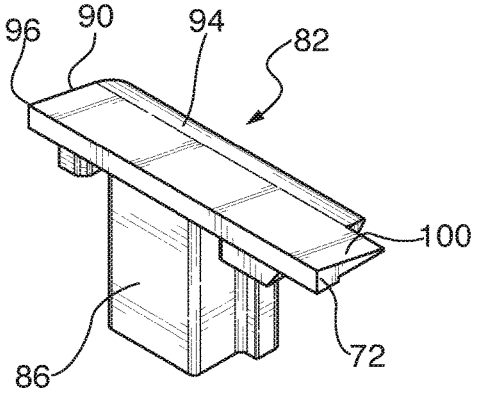
FIG. 8 is a top perspective of a right insert of the present tip.
Figure 10:
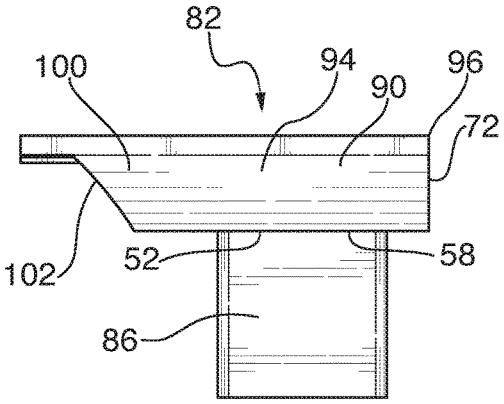
FIG. 10 is a front elevation view of the insert of FIG. 8.
Figure 9:
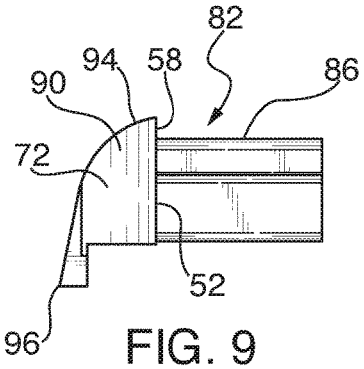
FIG. 9 is a left side view of the insert of FIG. 8.
Figure 11:
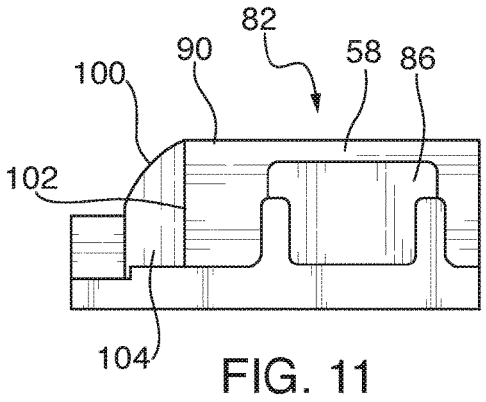
FIG. 11 is a bottom plan view of the insert of FIG. 8.
Figure 12:
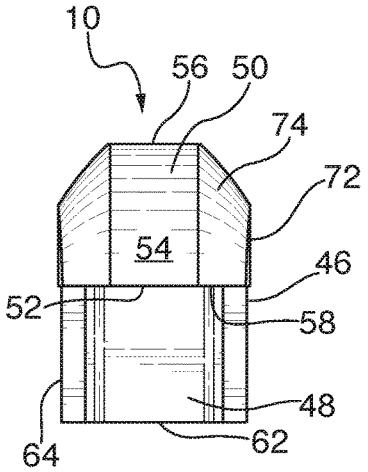
FIG. 12 is a front elevation of the center insert of the present tip.

While it is contemplated that the configuration may vary to suit the situation, the upper angled ends 88, 90 define a relatively sharp upper edge 96. Also, the tongues 84, 86 are each generally "T"-shaped when viewed in horizontal cross-section, or from below as seen in FIGS. 5 and 11. As is the case with the tip 10, the tongues 84, 86 are preferably secured in the respective channels 42, 44 by epoxy or other chemical adhesive, however separate fasteners are contemplated, depending on the application (FIG. 16).

Another feature of the supplemental tips 80, 82 is that each has an overlapping portion 98, 100 of the angled upper end 88, 90 that overhangs a portion of the tip 10, also referred to as the first tip, for accommodating pivoting movement of the door 14 relative to the door frame 16, and for further preventing any support for a ligature. It is further preferred that each of the overlapping portions 98, 100 defines a recess 102 dimensioned for accommodating a portion of the upper angled end 50 of the first tip 10 as seen in FIGS. 1 and 2. The supplemental tips 80, 82 accommodate the relative pivoting action of the door 14 relative to the frame 16, and during this action the overlapping portions 98, 100 slidingly engage the first tip 10. Further, it is preferred that the recess 102 is defined in part by a rear wall 104 of each supplemental tip 80, 82. Thus, for hinges with three channels, 34, 42, and 44, the tips are provided in a set including tips 10, 80 and 82. The tips 80, 82 share other common features with the tip 10, such as the overhang 58, the top of the tongue 52, side surfaces 72, which are commonly marked in the FIGs.

Referring now to FIG. 16, an alternate embodiment to the tip 10 is designated 110. Shared components between the embodiments 10 and 110 are designated with identical reference numbers. The tips 10, 80, 82 from embodiment 10 are modified and now designated 10', 80', and 82'. A main distinctive feature of the tip 110 is that the tongue 48 is provided with a depending eyelet portion 112, having an aperture 114 receiving a threaded fastener 116 for securing the tip to the hinge 12, in this case to the leaf 28. It is also contemplated that any of the tips, 10', 80', 82' are optionally provided with such eyelet portions 112, depending on the application.

While a particular embodiment of the present tip for geared hinge has been described herein, it will be appreciated by those skilled in the art that changes and modifications may be made thereto without departing from the invention in its broader aspects and as set forth in the following claims.

The invention claimed is:

1. A set of tips for use with a geared hinge including a first leaf, a second leaf and a cap enclosing complementary meshed geared ends of the first and the second leaves, each of the first leaf, the second leaf and the cap defining a channel, said tips comprising:

a first tip with a first body having a first depending tongue configured for complementary engagement in the cap channel, and a first angled upper end projecting vertically from said tongue, said first angled upper end including a first inclined surface extending from a top portion to said first tongue, said first inclined surface defining a first overhang extending on at least one side of said first tongue for covering the cap channel;

a second tip having a second body with a second depending tongue configured for insertion in the first leaf channel, and a second angled upper end with a second inclined surface defining a second overhang covering the first leaf channel; and a third tip having a third body with a third depending tongue configured for insertion in the second leaf channel, a third angled upper end with a third inclined surface defining a third overhang covering the second leaf channel;

wherein the first, second, and third tips are cooperatively configured for preventing a top of the geared hinge from functioning as a holding or retention point for a ligature.

2. The set of tips of claim 1, wherein each of said second and third tips includes an overlapping portion of said respective second and third angled upper end that overlaps a portion of said first tip for accommodating pivoting movement of a door relative to a door frame.

3. The set of tips of claim 2, wherein each overlapping portion defines a recess dimensioned for accommodating a portion of said first angled upper end of said first tip.

4. The set of tips of claim 3, wherein each recess is defined in part by a respective rear wall of said second and third tips.

5. The set of tips of claim 2, wherein each of said overlapping portions engages one of a left and right side portion of said first angled upper end.

6. A continuous gear hinge, comprising:

a first leaf having a free end and a geared end;

a second leaf having a free end and a geared end;

a cap defining a cap channel dimensioned for enclosing said geared ends, and having a pair of elongate ribs defining a pivot point for each of said first and second leaves;

a first tip having a first body with a first depending tongue inserted in said cap channel for complementary engagement with said cap channel; and a first angled upper end projecting vertically from said first tongue, said first angled upper end including a first inclined surface extending from a top portion to said first tongue, said first inclined surface defining a first overhang extending on at least one side of said first tongue for covering said cap channel;

wherein the first tip is configured for preventing a top of the geared hinge from functioning as a holding or retention point for a ligature.

7. The hinge of claim 6, further including:

a first leaf channel formed in the first leaf;

a second leaf channel formed in the second leaf;

a second tip having a second body with a second depending tongue inserted in the first leaf channel, and a second angled upper end with a second inclined surface defining a second overhang covering the first leaf channel; and a third tip having a third body with a third depending tongue inserted in the second leaf channel, a third angled upper end with a third inclined surface defining a third overhang covering the second leaf channel.

8. The hinge of claim 7, wherein each of said second and third tips includes an overlapping portion of said respective second and third angled upper end that overlaps a portion of said first tip for accommodating pivoting movement of a door relative to a door frame.

9. The hinge of claim 6, further including a rear wall on said first body for covering an opening in said cap channel.

10. The hinge of claim 6, wherein said first tongue is provided with a pair of cylindrical grooves for slidingly engaging the ribs on the cap forming pivot points of the first and second leaves.

11. The hinge of claim 6, wherein said first inclined surface is located between a pair of side surfaces, each having an inclined portion.

12. The hinge of claim 11, wherein said first inclined surface has an area greater than either of said side surfaces.

13. The hinge of claim 6, wherein said top portion of said first angled upper end has a planar portion.

14. The hinge of claim 6, wherein said first angled upper end defines a sharp upper edge.

15. The hinge of claim 6, wherein said first tongue is generally T-shaped when viewed in horizontal cross-section.

16. The hinge of claim 8, wherein each overlapping portion defines a recess dimensioned for accommodating a portion of said first angled upper end of said first tip.

17. The hinge of claim 16, wherein each recess is defined in part by a respective rear wall of said second and third tips.

* * * * *